US006238182B1

(12) United States Patent
Mayer

(10) Patent No.: US 6,238,182 B1
(45) Date of Patent: May 29, 2001

(54) JOINT FOR A TURBINE COMPONENT

(75) Inventor: Ed Mayer, Hamilton, OH (US)

(73) Assignee: Meyer Tool, Inc., Cincinnati, OH (US)

( * ) Notice: Subject to any disclaimer, the term of this patent is extended or adjusted under 35 U.S.C. 154(b) by 0 days.

(21) Appl. No.: 09/255,611

(22) Filed: Feb. 19, 1999

(51) Int. Cl.[7] ..... F01D 5/18

(52) U.S. Cl. ..... 416/96 A; 416/97 R; 415/115

(58) Field of Search ..... 415/115; 416/96 R, 416/96 A, 97 R, 97 A, 232, 233; 403/270, 271, 272; 228/135, 189

(56) References Cited

U.S. PATENT DOCUMENTS

| | | | | |
|---|---|---|---|---|
| 2,782,862 | * | 2/1957 | Wright | 416/233 |
| 2,923,525 | * | 2/1960 | Creek | 416/233 |
| 3,369,792 | * | 2/1968 | Kraimer et al. | 415/115 |
| 3,388,888 | * | 6/1968 | Kercher et al. | 415/115 |
| 3,700,348 | | 10/1972 | Corsmeier et al. . | |
| 3,767,322 | | 10/1973 | Durgin et al. . | |
| 4,218,179 | | 8/1980 | Barry et al. . | |
| 5,100,293 | | 3/1992 | Anzai et al. . | |
| 5,533,864 | | 7/1996 | Nomoto et al. . | |

FOREIGN PATENT DOCUMENTS

| | | | | |
|---|---|---|---|---|
| 737642 | * | 7/1943 | (DE) | 403/272 |
| 738874 | * | 9/1943 | (DE) | 403/272 |
| 749763 | * | 12/1944 | (DE) | 403/272 |
| 2017229 | * | 10/1979 | (GB) | 416/97 R |
| 61-51124 | * | 11/1986 | (JP) | 415/115 |

* cited by examiner

*Primary Examiner*—Christopher Verdier
(74) *Attorney, Agent, or Firm*—Wood, Herron & Evans, L.L.P.

(57) ABSTRACT

An improved joint for a turbine component including an outer wall member, an inner wall member disposed within the outer wall member, and at least one air channel formed therebetween. The improved joint preferably includes a plurality of elongated ribs extending from one of the outer and inner wall members, and a plurality of elongated grooves spaced from the other wall member and facing in registry with the plurality of ribs. The ribs are received in the grooves at joint interfaces to form a plurality of joints for interconnecting the inner and outer wall members. The formation of the elongated ribs and grooves in the improved joint provides a mechanical interlock at the joint interface to improve the strength of the joints, as well as to reduce undesirable heat transfer through the joints.

23 Claims, 2 Drawing Sheets

JOINT FOR A TURBINE COMPONENT

FIELD OF THE INVENTION

The present invention relates generally to joints and connections and, more particularly, to an improved joint for a turbine component such as a turbine blade or vane.

BACKGROUND OF THE INVENTION

In the assembly of turbine blades and vanes, it is known in the art to mount or secure an inner wall member of air foil cross-section within an outer wall member also having an air foil cross-section. Typically, the inner wall member or insert includes a radially outwardly directed collar at one end of the insert that is brazed or otherwise joined to surfaces of the outer wall member. The inner wall member may include dimples or other protuberance structures extending outwardly from an outer surface of the insert that align or register the insert relative to an inner surface of the outer wall member. The assembled turbine component includes one or more air chambers formed between the outer and inner wall members that are used to cool the outer wall member during operation of the turbine engine.

Typically, compressed air from a compressor of the turbine engine is delivered to one or more inner chambers of the inner wall member or insert. The compressed air discharges through apertures formed through the inner wall member as a series of high velocity air jets that impinge upon and cool the inner surfaces of the outer wall member. Air is also discharged through apertures formed through the outer wall member to provide a cooling air film that travels over the outer surfaces of the outer wall member from the leading edge to the trailing edge. In this way, the turbine component is able to survive in the hot gas environment of the turbine engine without structural damage.

Notwithstanding advances made in the manufacture of turbine blades and vanes having an inner wall member or insert mounted or secured within an outer wall member, there is still a need for an improved joint for turbine components that provides a strong and reliable connection between the outer and inner wall members during operation of the turbine engine.

SUMMARY OF THE INVENTION

The present invention overcomes the foregoing and other shortcomings and drawbacks of turbine components and assembly methods heretofore known. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, an improved joint is provided for a turbine component including an outer wall member, an inner wall member or insert disposed within the outer wall member, and at least one air channel formed therebetween. The improved joint preferably includes a plurality of elongated ribs of V-shaped cross-section extending from the inner wall member. The elongated ribs preferably extend substantially across the entire width of the inner wall member or insert.

The improved joint further preferably includes a plurality of elongated protrusions extending from the outer wall member that terminate in V-shaped grooves spaced from the outer wall member. The elongated ribs and V-shaped grooves are arranged to face in registry upon assembly of the turbine component so that the ribs are slidably received in the V-shaped grooves. Braze material is preferably disposed at the joint interfaces between the elongated ribs and V-shaped grooves to from a plurality of braze joints for interconnecting the inner and outer wall members.

The formation of the elongated ribs and V-shaped grooves in the improved joint of the present invention provides a mechanical interlock at the joint interfaces to significantly increase the strength of the braze joints and their ability to resist shearing forces that may occur during use of the turbine component in a turbine engine. The elongated ribs and V-shaped grooves also provide for accurate registration or alignment of the outer and inner wall members during assembly of the turbine component. Moreover, the joints formed by the elongated ribs and V-shaped grooves from partition walls that define air chambers between the outer and inner wall members that improve cooling of the outer wall member.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
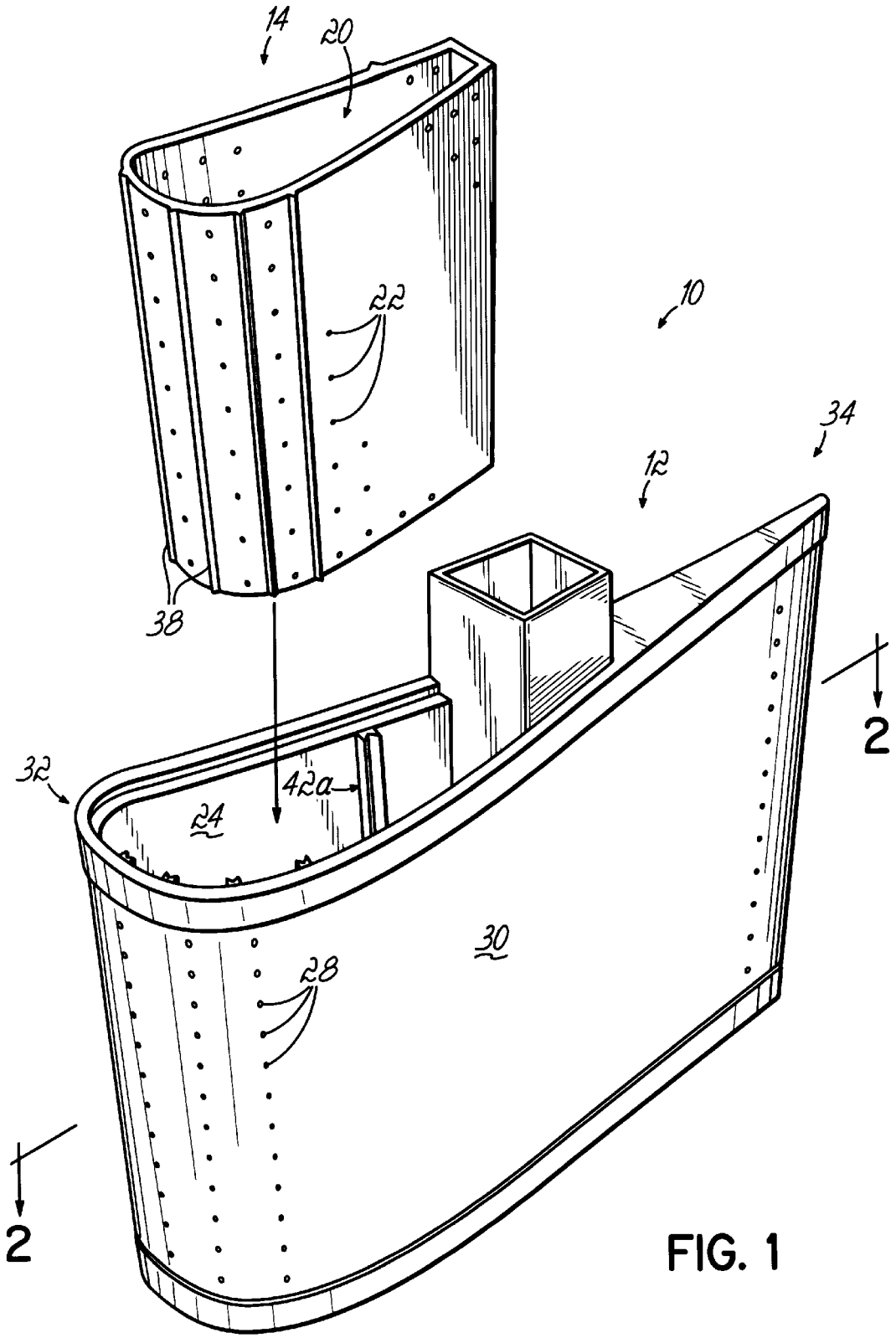
FIG. 1 is a disassembled perspective view of a turbine component including a plurality of joints in accordance with the principles of the present invention for interconnecting outer and inner wall members of the turbine component.
Figure 2:
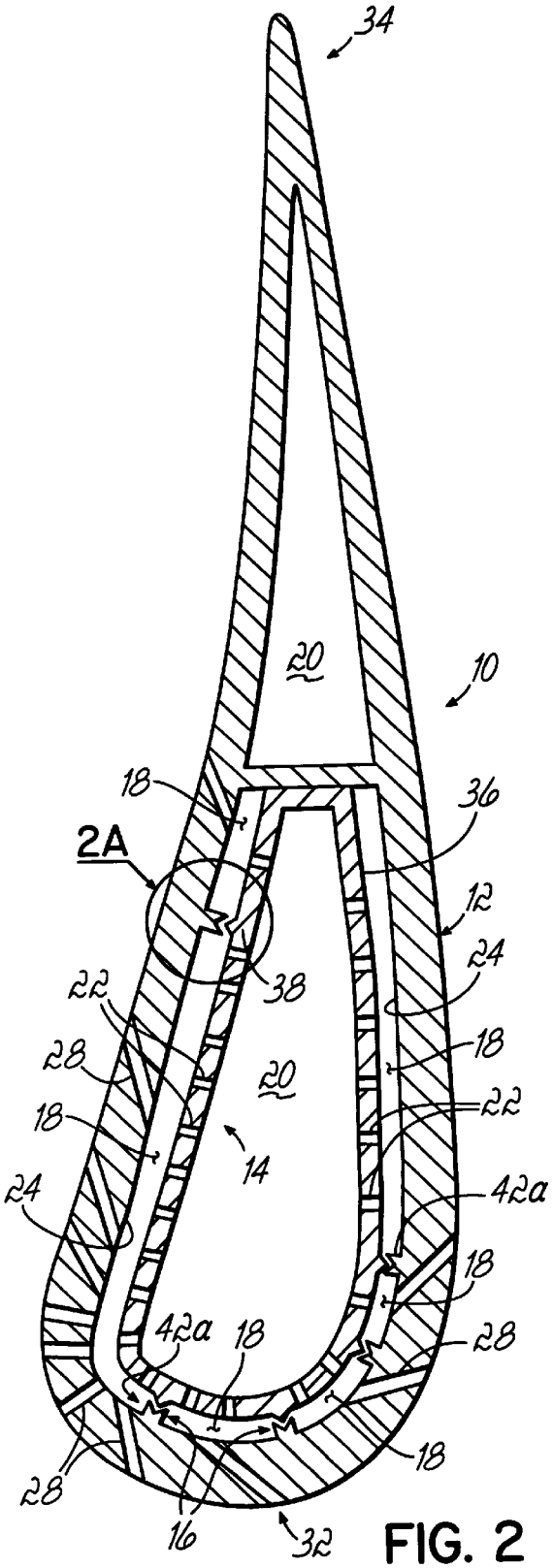
FIG. 2 is a cross-sectional view taken along line 2—2 of FIG. 1.

With reference to the figures, and to FIGS. 1 and 2 in particular, a turbine component 10, such as a turbine blade or vane as illustrated in the figures, is shown in accordance with the principles of present invention. Turbine component 10 includes a cast or otherwise formed outer wall member 12 of generally air foil cross-section, and a cast or otherwise formed inner wall member or insert 14 also of generally air foil cross-section. As described in greater detail below, inner wall member 14 is inserted and preferably brazed within with the outer wall member 12 at joints 16 (FIGS. 2, 2A and 3) to form partitioned air chambers 18 between the outer and inner wall members 12 and 14, respectively.

As will be appreciated by those of ordinary skill in the art, compressed air is provided to inner air chambers 20 within the inner wall member 14 from a compressor of a turbine engine (not shown). The compressed air discharges through apertures 22 formed through the inner wall member 14 as a series of high velocity air jets that impinge upon and cool the inner surfaces 24 of the outer wall member 12 during operation of the turbine engine (not shown). Air within the partitioned air chambers 18 is discharged through apertures 28 formed through the outer wall member 12 to provide a cooling air film that travels over the outer surfaces 30 of the outer wall member 12 from the leading edge 32 to the trailing edge 34 of the turbine component 10.

In accordance with one aspect of the present invention, the inner wall member or insert 14 of turbine component 10 is provided on its outer surface 36 with one or more joint members preferably in the form of elongated ribs 38 that extend substantially across the entire width of the inner wall member 14. Each elongated rib 38 preferably includes a pair of converging walls 40 extending from the outer surface 36 that form ribs 38 of preferably V-shaped cross-section as shown most clearly in FIGS. 2, 2A and 3. In this way, the elongated ribs 38 provide male joint structures extending outwardly from the outer surface 36 of the inner wall member or insert 14 for purposes to be described in greater detail below.

Figure 2A:
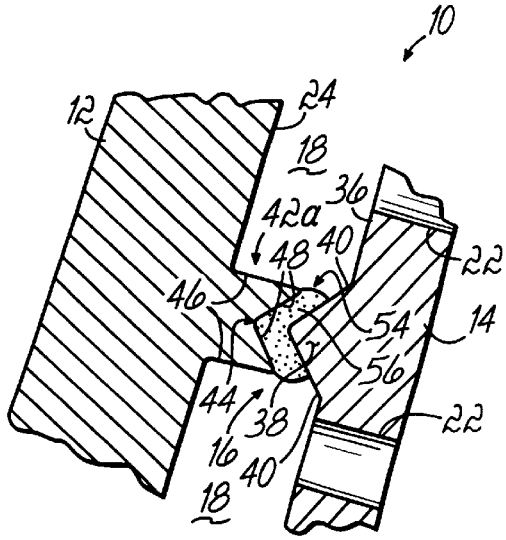
FIG. 2A is an enlargement of the circled area of FIG. 2 illustrating a joint in accordance with one embodiment of the present invention.
Figure 3:
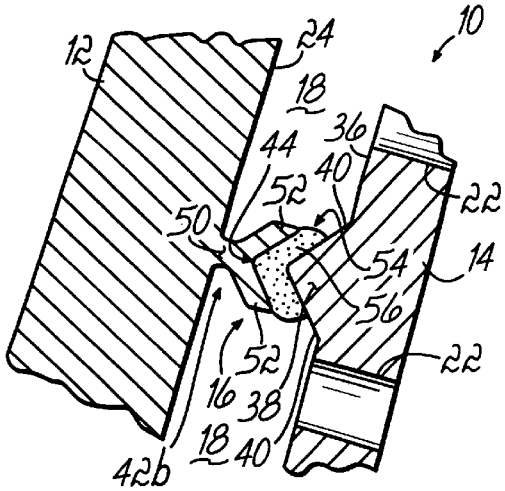
FIG. 3 is a view similar to FIG. 2A illustrating a joint in accordance with an alternative embodiment of the present invention.

As shown most clearly in FIGS. 2, 2A and 3, the outer wall member 12 of turbine component 10 is provided on its inner surface 24 with one or more joint members preferably in the form of elongated protrusions 42*a* (FIGS. 2 and 2A) and 42*b* (FIG. 3) that terminate in elongated V-shaped grooves 44. The elongated protrusions 42*a*, 42*b* and V-shaped grooves 44 preferably extend substantially across the entire width of the outer wall member 12 to provide female joint structures extending outwardly from the inner surface 24 of the outer wall member 12.

In one aspect of the present invention, as shown most clearly in FIGS. 2 and 2A, the elongated protrusions 42*a* each include a pair of elongated, spaced side walls 46 that extend substantially transverse to the inner surface 24 of the outer wall member 12, and define the cross-sectional width of protrusion 42*a*. The elongated V-shaped grooves 44 are formed at a terminal end of each protrusion 42*a* by a pair of diverging walls 48 so that the V-shaped grooves 44 are preferably spaced from the inner surface 24 of the outer wall member 12.

In accordance with another aspect of the present invention, as shown most clearly in FIG. 3, each of the elongated protrusions 42*b* has a substantially Y-shaped cross-section. More particularly, each protrusion 42*b* includes an elongated web 50 extending substantially transverse to the inner surface 24 of the outer wall member 12, and a pair of diverging webs 52 extending outwardly from web 50. Each pair of diverging webs 52 defines the V-shaped grooves 44 at terminal ends of each protrusion 42*b* so that the V-shaped grooves 44 are preferably spaced from the inner surfaces 24 of the outer wall member 12.

The elongated protrusions 42*a* and 42*b* and their associated V-shaped grooves 44 are formed to face in registry with the elongated ribs 38 so that, during assembly of the turbine component 10 as shown in FIG. 1, the elongated ribs 38 are slidably received within the V-shaped grooves 44 to form joint interfaces 54 between the ribs 38 and the V-shaped grooves 44. As shown most clearly in FIGS. 2A and 3, braze material, shown diagrammatically at 56, is preferably disposed at the joint interfaces 54 between the elongated ribs 38 and the V-shaped grooves 44 to form one or more braze joints for interconnecting the outer and inner wall members 12 and 14 as will be readily appreciated by those of ordinary skill in the art.

Preferably, the joint interfaces 54 are spaced from the inner surface 24 of the outer wall member 12, and the outer surface 36 of the inner wall member 14. In this way, undesirable heat transfer through each joint 16 is reduced by the minimal cross-sectional widths of protrusions 42*a* and 42*b* extending from the substantially hotter outer wall member 12. Moreover, the mechanical interlock provided at each of the joint interfaces 54 significantly increases the strength of the joints 16 and their ability to resist shearing forces that may occur during use of turbine component 10 in a turbine engine (not shown). The elongated ribs 38 and V-shaped grooves 44 also provide for accurate registration or alignment of the outer and inner wall members 12 and 14 during assembly of the turbine component 10. Additionally, the joints 16 formed by the elongated ribs 38 and V-shaped grooves 44 form partition walls that define the air chambers 18 between the outer and inner wall members 12 and 14 that improve cooling of the outer wall member 12.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of applicant's general inventive concept.

For example, while the elongated ribs 38 are illustrated and described as extending outwardly from the outer surface 36 of the inner wall member 14, the arrangement of the ribs 38 and the elongated protrusions 42*a* and 42*b* may be reversed, with the protrusions 42*a* and 42*b* extending outwardly from the outer surface 36 of the inner wall member 14, and the elongated ribs 38 extending outwardly from the inner surface 24 of the outer wall member 12. Moreover, while ribs 38 of V-shaped cross-section and V-shaped grooves 44 are preferred, other configurations of male and female joint structures will be readily appreciated by those of ordinary skill in the art without departing from the spirit and scope of applicant's invention. For example, the ribs 38 may have a rounded or other form of convex cross-section that is adapted to cooperate at the joint interfaces 54 with a mating concave groove. Additionally, the male and female joint structures may not extend substantially across the entire width of the outer and inner wall members 12 and 14. While the present invention is useful in the assembly of turbine components as described in detail above, those of ordinary skill in the art will appreciate the many various other joint applications to which the present invention is applicable without departing from the spirit and scope of applicant's invention.

Having described the invention, what is claimed is:

1. An improved joint for a turbine component including an outer wall member, an inner wall member disposed within the outer wall member, and at least one air chamber formed therebetween, the joint comprising:

a plurality of first joint members extending from the outer wall member toward the inner wall member; and a plurality of second joint members extending from the inner wall member toward the outer wall member and facing in registry with the first joint members, each of the first and second joint members cooperating at a joint interface to form a plurality of joints for interconnecting the inner and outer wall members, wherein one of the first and second joint members comprises an elongated protrusion having a generally Y-shaped cross-section and terminating in a generally V-shaped groove.

2. The improved joint of claim 1, further including braze material disposed at the joint interfaces between the first and second joint members.

3. The improved joint of claim 1, wherein one of the first and second joint members comprises a male structure and the other comprises a female structure, wherein the male structure is received within the female structure at the joint interface.

4. The improved joint of claim 1, wherein one of the first and second joint members comprises an elongated rib having a generally V-shaped cross-section.

5. The improved joint of claim 1, wherein the first joint members extend substantially the entire width of the outer wall member.

6. The improved joint of claim 5, wherein the second joint members extend substantially the entire width of the inner wall member.

7. The improved joint of claim 6, wherein the first and second joint members cooperate at the joint interfaces to form walls that define a plurality of air chambers between the outer and inner wall members.

8. The improved joint of claim 1, wherein the outer wall member has a generally air foil cross-section.

9. The improved joint of claim 1, wherein the inner wall member has a generally air foil cross-section.

10. The improved joint of claim 1, wherein the outer wall member includes a plurality of apertures extending through the thickness thereof that communicate with the at least one air chamber.

11. The improved joint of claim 1, wherein the joint interfaces are spaced from the outer and inner wall members.

12. An improved joint for a turbine component including an outer wall member, an inner wall member disposed in spaced relation within the outer wall member to form a space therebetween, and at least one air chamber formed in the space between the outer and inner wall members, the joint comprising:

a plurality of elongated ribs extending outwardly from a surface of one of the outer and inner wall members toward the other and formed as enlarged cross-sectional thickness portions of the one wall member;

a plurality of elongated grooves spaced outwardly from a surface of the other of the outer and inner wall members and facing in registry with the plurality of ribs, each of the ribs being received in one of the grooves at a joint interface to form a plurality of joints for interconnecting the inner and outer wall members; and braze material disposed at the joint interfaces between the plurality of ribs and the plurality of grooves.

13. The improved joint of claim 12, wherein each of the elongated ribs has a generally V-shaped cross-section.

14. The improved joint of claim 12, wherein each of the elongated grooves is disposed at a terminal end of an elongated protrusion that extends from the other of the outer and inner wall members.

15. The improved joint of claim 14, wherein the elongated protrusion has a generally Y-shaped cross-section.

16. The improved joint of claim 12, wherein the plurality of ribs extend substantially the entire width of one of the outer and inner wall members.

17. The improved joint of claim 12, wherein the plurality of grooves extend substantially the entire width of one of the inner and outer wall members.

18. The improved joint of claim 12, wherein the plurality of ribs and plurality of grooves cooperate at the joint interfaces to form walls that define a plurality of air chambers between the outer and inner wall members.

19. A turbine vane, comprising:

an outer wall member having a generally air foil cross-section;

an inner wall member having a generally air foil cross-section disposed in spaced relation within the outer wall member to form a space therebetween;

at least one air chamber formed in the space between the outer and inner wall members;

a plurality of elongated ribs extending outwardly from a surface of one of the outer and inner wall members toward the other and formed as enlarged cross-sectional thickness portions of the one wall member; and a plurality of elongated grooves spaced outwardly from a surface of the other of the outer and inner wall members and facing in registry with the plurality of ribs, each of the ribs being received in one of the grooves at a joint interface to form a plurality of joints for interconnecting the inner and outer wall members; and braze material disposed at the joint interfaces between the plurality of ribs and the plurality of grooves.

20. The improved joint of claim 19, wherein each of the elongated grooves is disposed at a terminal end of an elongated protrusion that extends from the other of the outer and inner wall members.

21. The improved joint of claim 20, wherein the elongated protrusion has a generally Y-shaped cross-section.

22. An improved joint for a turbine component including an outer wall member, an inner wall member disposed within the outer wall member, and at least one air chamber formed therebetween, the joint comprising:

a plurality of elongated ribs extending from one of the outer and inner wall members toward the other; and a plurality of elongated grooves spaced from the other of the outer and inner wall members and facing in registry with the plurality of ribs, each of the ribs being received in one of the grooves at a joint interface to form a plurality of joints for interconnecting the inner and outer wall members, wherein each of the elongated grooves is disposed at a terminal end of an elongated protrusion having a generally Y-shaped cross-section that extends from the other of the outer and inner wall members.

23. A turbine vane, comprising:

an outer wall member having a generally air foil cross-section;

an inner wall member having a generally air foil cross-section disposed within the outer wall member, wherein the outer and inner walls form at least one air chamber therebetween;

a plurality of elongated ribs extending from one of the outer and inner wall members toward the other; and a plurality of elongated grooves spaced from the other of the outer and inner wall members and facing in registry with the plurality of ribs, each of the ribs being received in one of the grooves at a joint interface to form a plurality of joints for interconnecting the inner and outer wall members, wherein each of the elongated grooves is disposed at a terminal end of an elongated protrusion having a generally Y-shaped cross-section that extends from the other of the outer and inner wall members.

* * * * *

UNITED STATES PATENT AND TRADEMARK OFFICE

CERTIFICATE OF CORRECTION

PATENT NO. : 6,238,182 B1
DATED : May 29, 2001
INVENTOR(S) : Ed Mayer

It is certified that error appears in the above-identified patent and that said Letters Patent is hereby corrected as shown below:

Column 2,
Lines 4, and 15, please delete "from" and replace with -- form --.
Line 50, please delete "of present invention" and replace with -- of the present invention --.

Column 5, claim 4,
Line 9, please delete "one" and replace with -- the other --.

Signed and Sealed this

Nineteenth Day of February, 2002

*Attest:*

*Attesting Officer*

JAMES E. ROGAN
*Director of the United States Patent and Trademark Office*